US006691595B2

(12) United States Patent
Hsien

(10) Patent No.: US 6,691,595 B2
(45) Date of Patent: Feb. 17, 2004

(54) RETRACTABLE/FOLDING COLLAPSIBLE WRENCH

(76) Inventor: Chih-Ching Hsien, 235 Chung-Ho, Box 8-24, Taipei (TW)

( * ) Notice: Subject to any disclaimer, the term of this patent is extended or adjusted under 35 U.S.C. 154(b) by 0 days.

(21) Appl. No.: 10/208,899

(22) Filed: Jul. 29, 2002

(65) Prior Publication Data

US 2003/0066392 A1 Apr. 10, 2003

(30) Foreign Application Priority Data

Oct. 9, 2001 (TW) ..... 90217388 U

(51) Int. Cl.[7] ..... B25B 13/00
(52) U.S. Cl. ..... 81/124.5; 81/177.2; 16/115
(58) Field of Search ..... 81/177.2, 124.5; 16/115

(56) References Cited

U.S. PATENT DOCUMENTS

D325,864 S * 5/1992 Diego ..... D8/28
5,492,040 A * 2/1996 Bellas ..... 81/125.1
6,131,490 A * 10/2000 Lee ..... 81/63.1
6,370,990 B1 * 4/2002 Lin ..... 81/177.2
6,412,374 B1 * 7/2002 Hsieh ..... 81/177.7

* cited by examiner

*Primary Examiner*—Joseph J. Hail, III
*Assistant Examiner*—Alvin J. Grant
(74) *Attorney, Agent, or Firm*—Alan D. Kamrath; Rider Bennett, LLP

(57) ABSTRACT

A retractable/folding collapsible wrench is constructed to include a hollow handle, which can be made folding collapsible, two driving devices respectively moved in and out of the ends of the hollow handle between the extended position and the received position, and positioning means respectively mounted in the ends of the handle and adapted for securing the driving devices in one of a series of positions.

9 Claims, 29 Drawing Sheets

RETRACTABLE/FOLDING COLLAPSIBLE WRENCH

BACKGROUND OF THE INVENTION

The present invention relates to wrenches, and more specifically, to a retractable/folding collapsible wrench.

A variety of wrenches including combination wrenches, hex wrenches, ratchet wrenches, work angle-adjustable wrenches, and etc. have been disclosed for grasping nuts, bolts, etc., and have appeared on the market. FIGS. 50–52 show different combination wrenches constructed according to the prior art. These conventional wrenches have a fixed length. Because the length of conventional wrenches is not adjustable, they are not suitable for use in a narrow working space. Further, because conventional wrenches are not collapsible, they occupy much storage space when not in use.

SUMMARY OF THE INVENTION

The present invention has been accomplished under the circumstances in view. It is one object of the present invention to provide a wrench, which can be collapsed to reduce space occupation when not in use. According to one aspect of the present invention, the wrench comprises a hollow handle, two driving devices respectively moved in and out of the ends of the hollow handle between the extended position and the received position, and positioning means respectively mounted in the ends of the handle and adapted for securing the driving devices in one of a series of positions. According to another aspect of the present invention, the handle can be made having two handle elements pivoted together.

DETAILED DESCRIPTION OF THE PREFERRED EMBODIMENT

Figure 1:
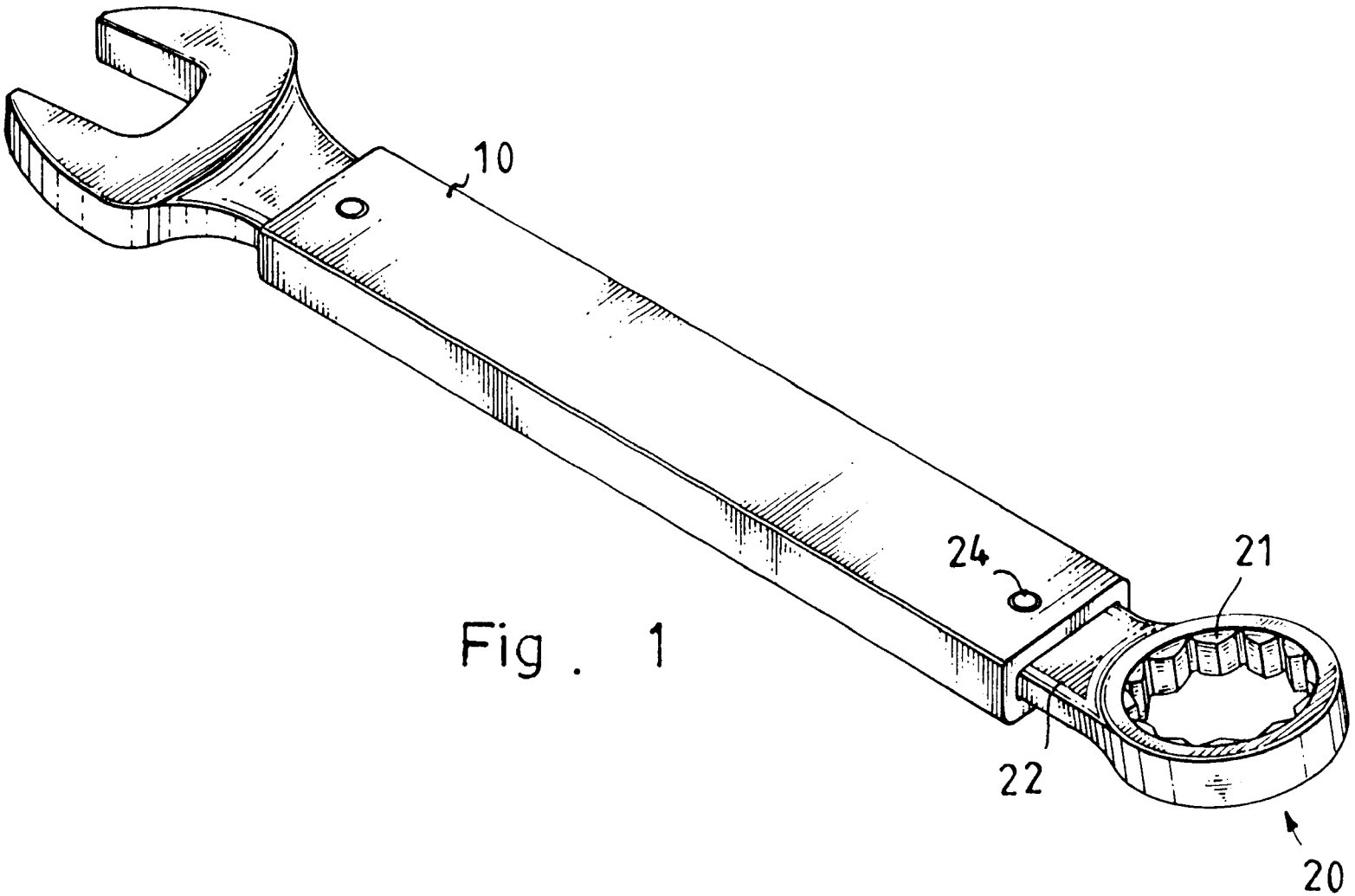
FIG. 1 is an elevational view of a first embodiment of the present invention.
Figure 2:
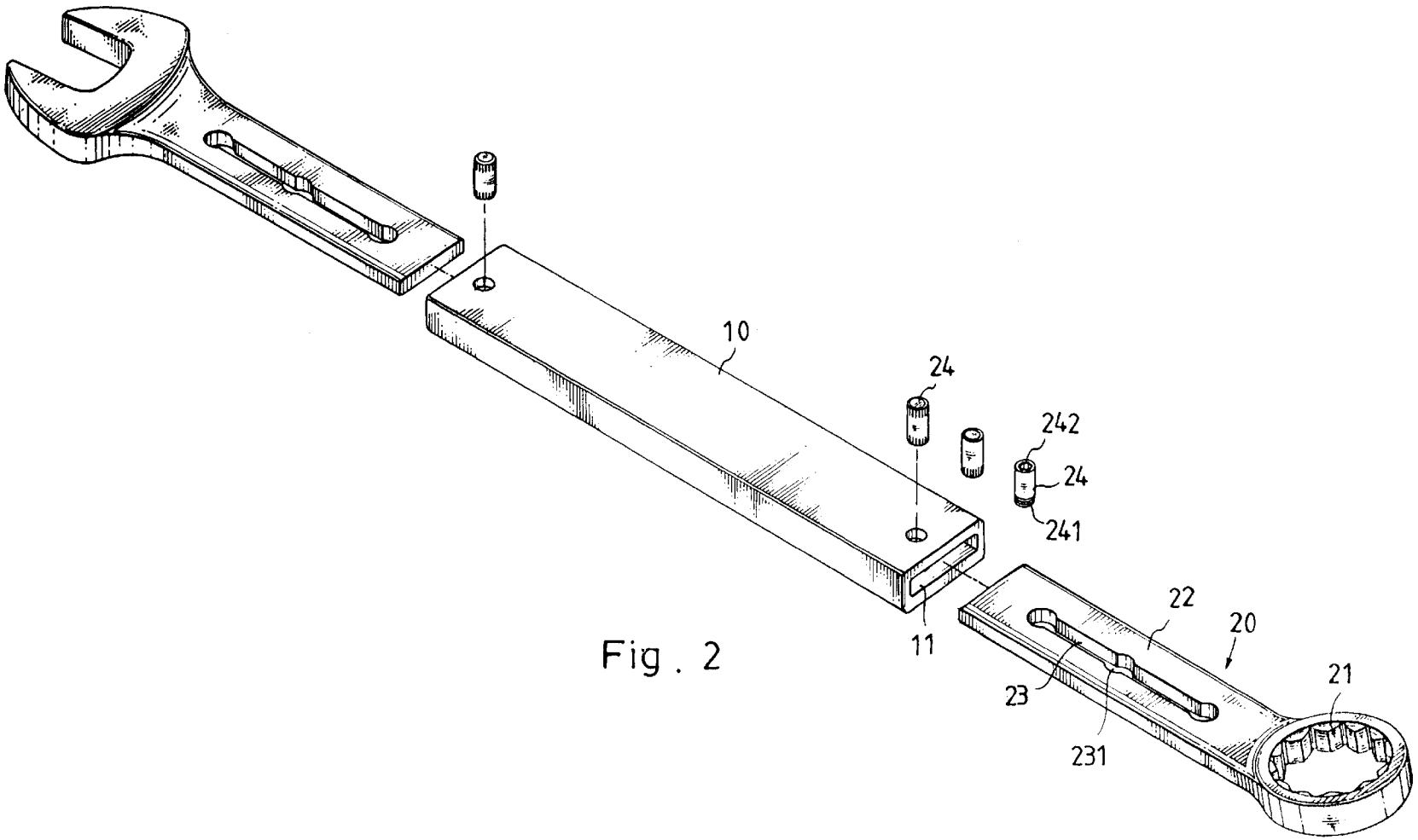
FIG. 2 is an exploded view of the first embodiment of the present invention.
Figure 4:
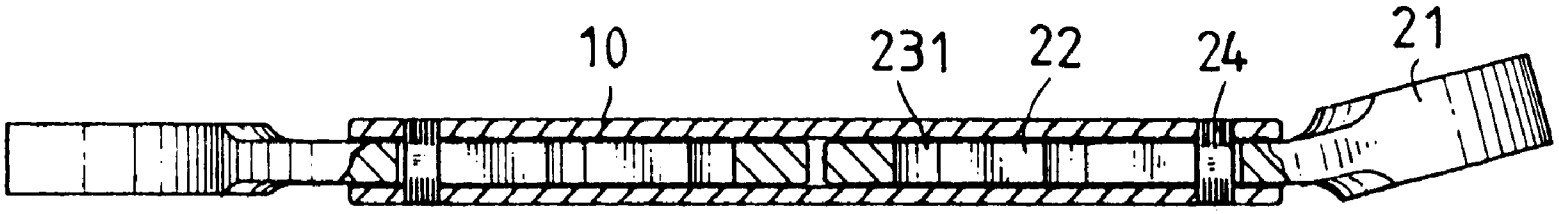
FIG. 4 is a sectional side view of the first embodiment of the present invention.
Figure 3:
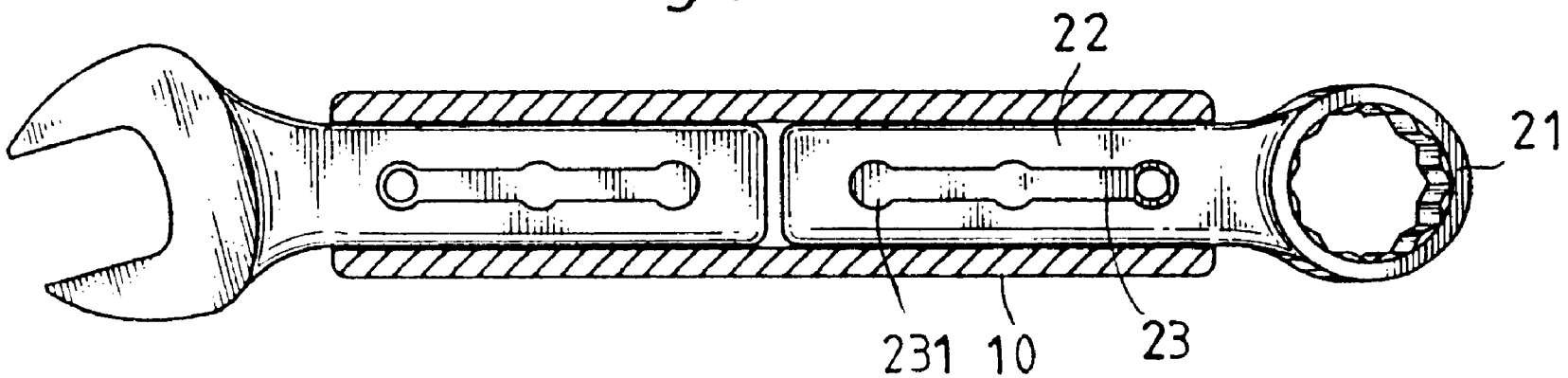
FIG. 3 is a sectional top view of the first embodiment of the present invention.
Figure 5:
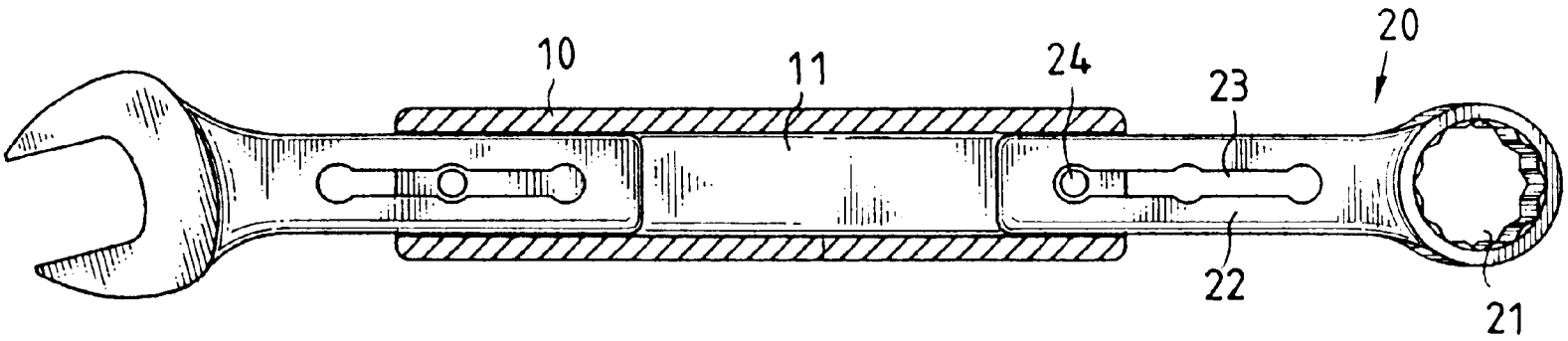
FIG. 5 is another sectional top view of the first embodiment of the present invention, showing the driving devices extended out of the handle.
Figure 6:
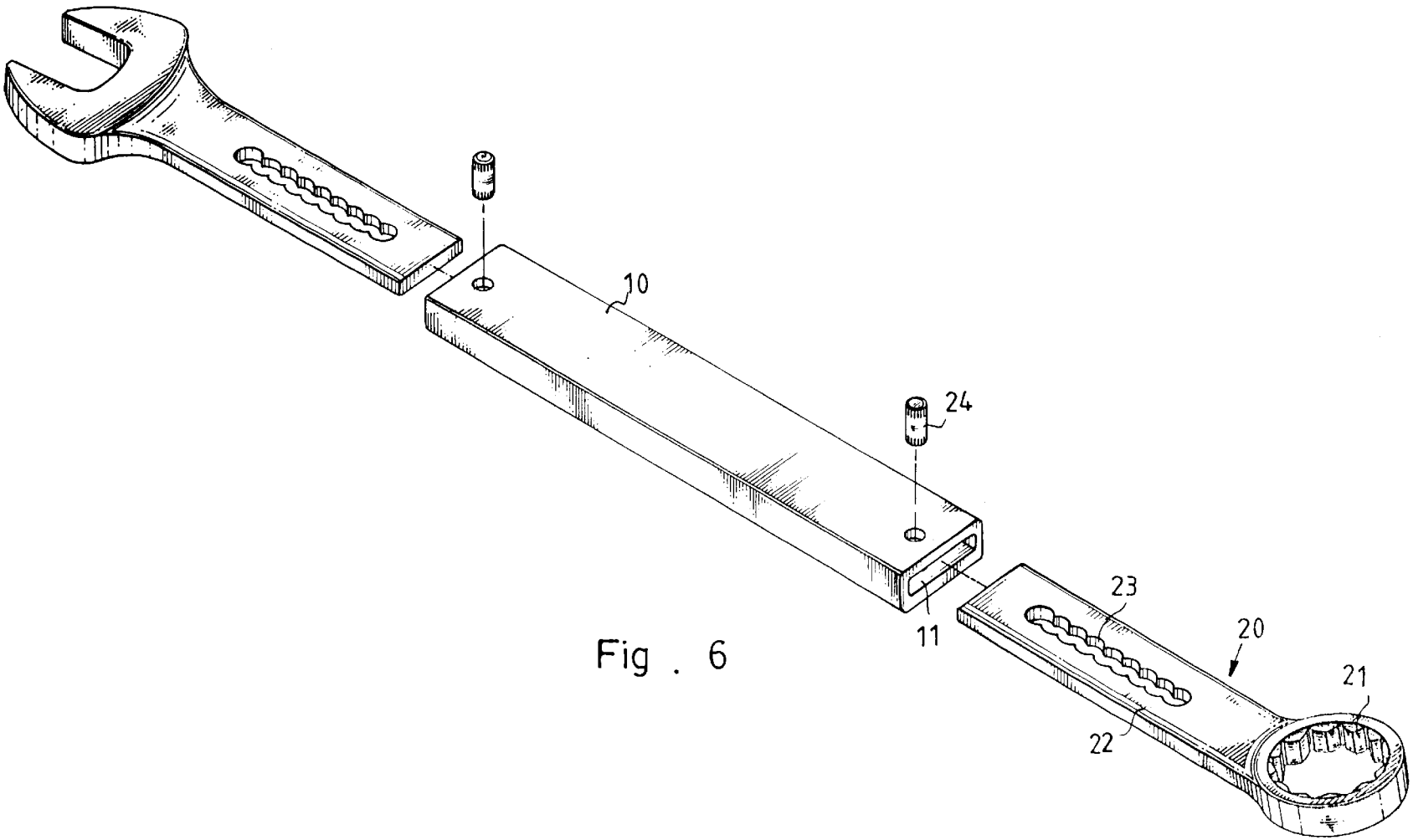
FIG. 6 is an exploded view of a second embodiment of the present invention.
Figure 7:
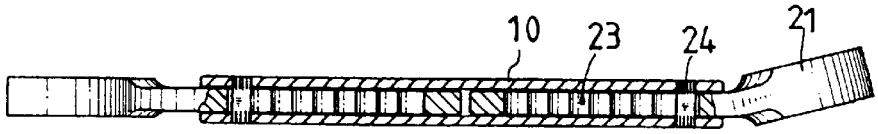
FIG. 7 is a sectional side view of the second embodiment of the present invention.
Figure 8:
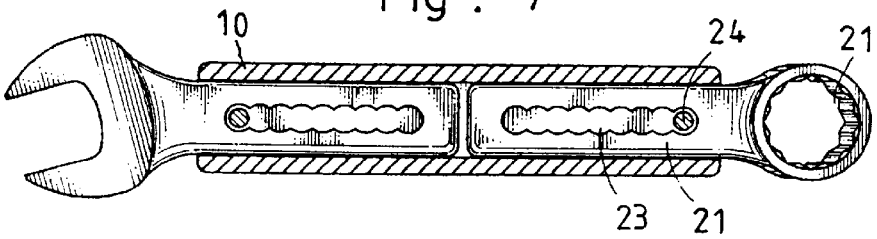
FIG. 8 is a sectional top view of the second embodiment of the present invention.
Figure 9:
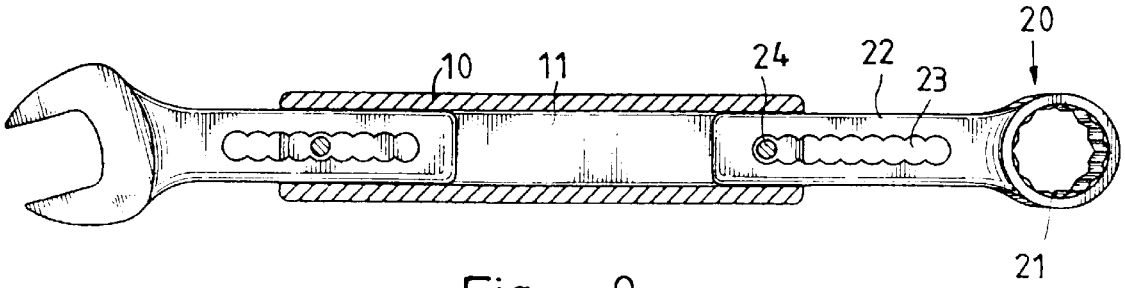
FIG. 9 is another sectional top view of the second embodiment of the present invention, showing the driving devices extended out of the handle.
Figure 10:
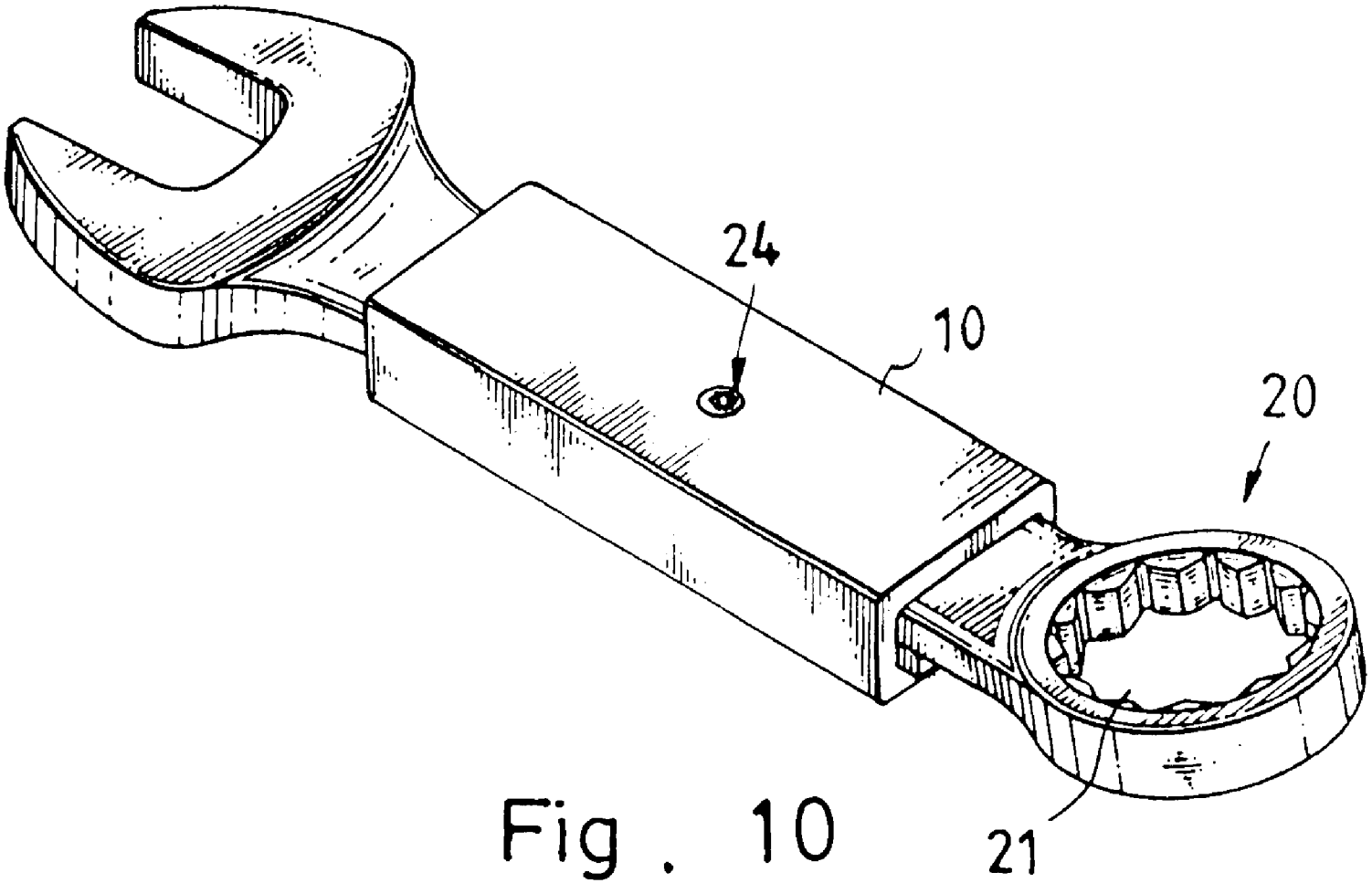
FIG. 10 is an elevational view of a third embodiment of the present invention.
Figure 11:
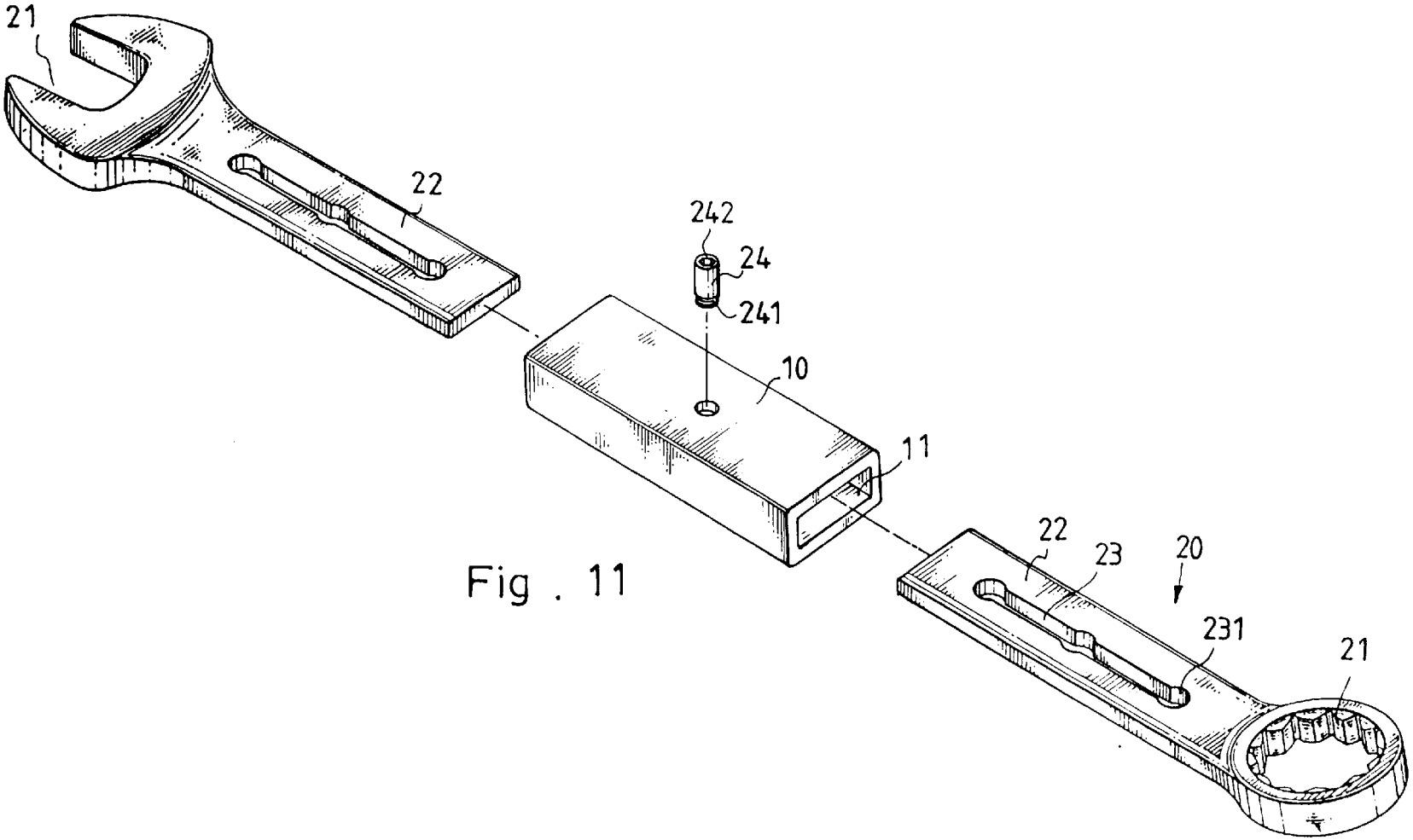
FIG. 11 is an exploded view of the third embodiment of the present invention.
Figure 12:
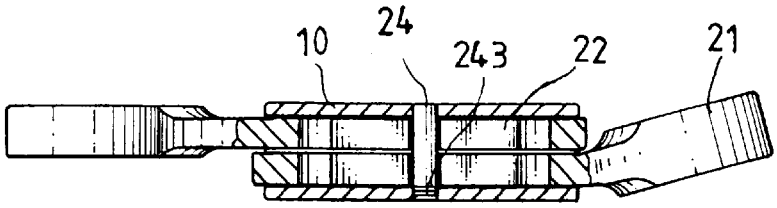
FIG. 12 is a sectional side view of the third embodiment of the present invention.
Figure 13:
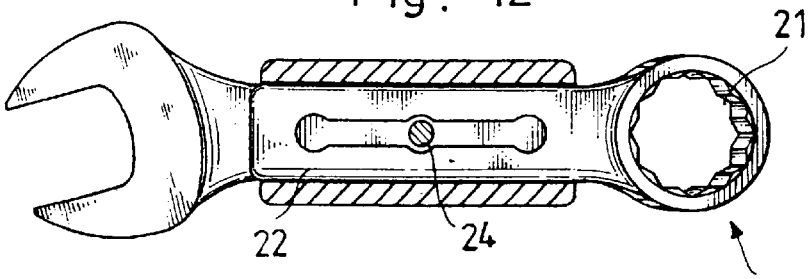
FIG. 13 is a sectional top view of the third embodiment of the present invention.
Figure 14:
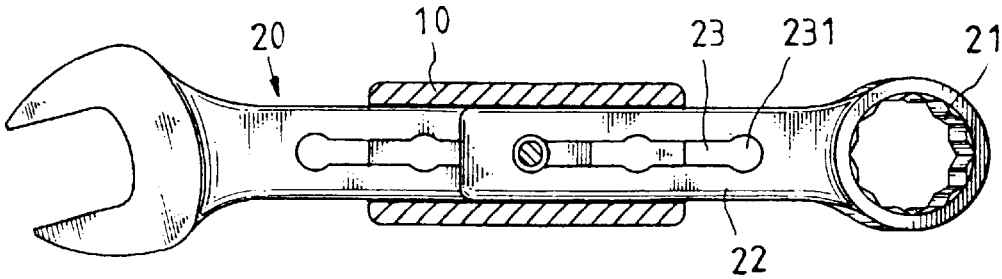
FIG. 14 is another sectional top view of the third embodiment of the present invention showing the driving devices extended out of the handle.
Figure 15:
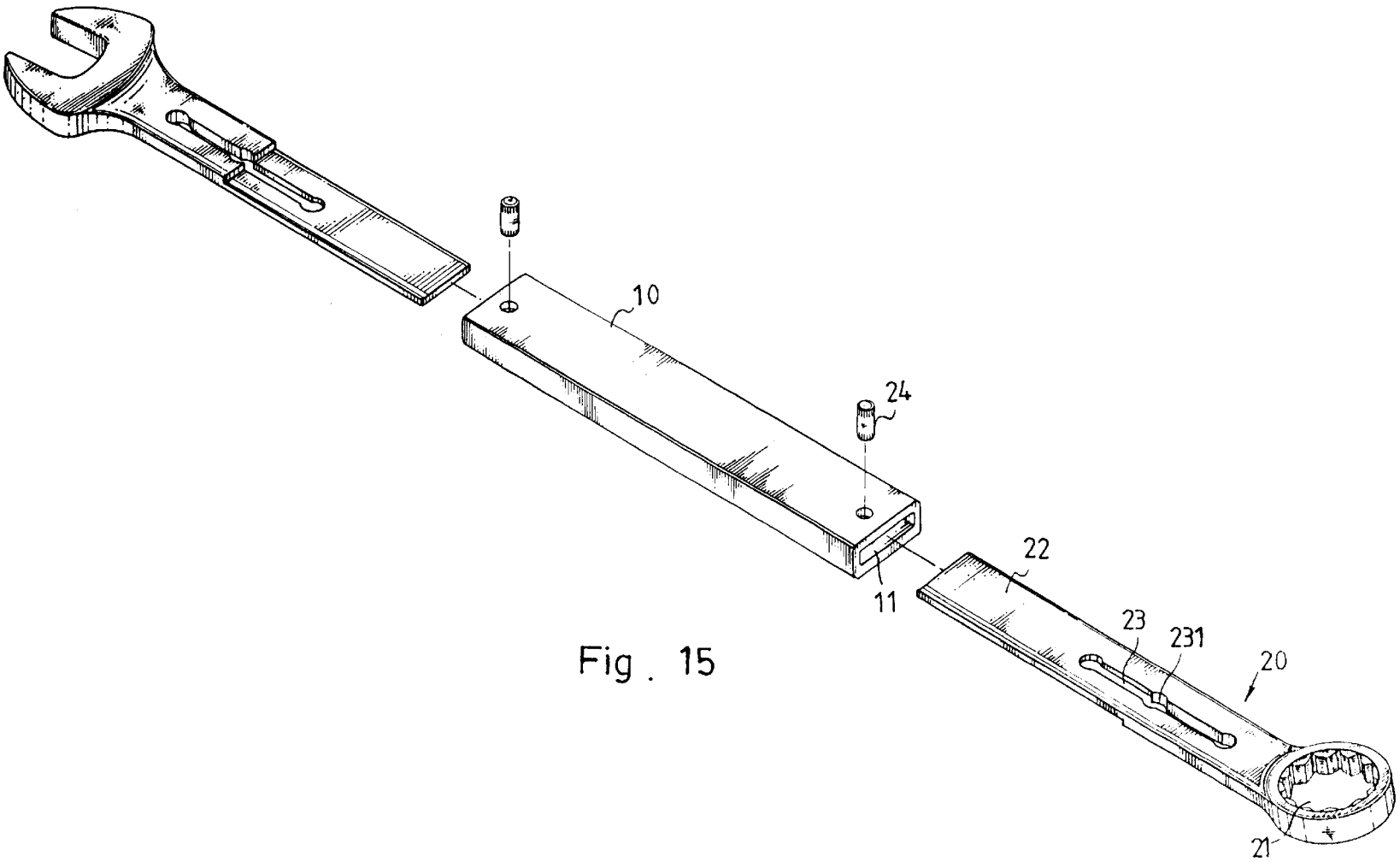
FIG. 15 is an exploded view of a fourth embodiment of the present invention.
Figure 16:
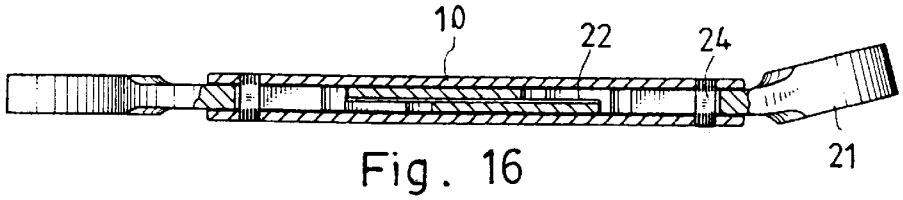
FIG. 16 is a sectional side view of the fourth embodiment of the present invention.
Figure 17:
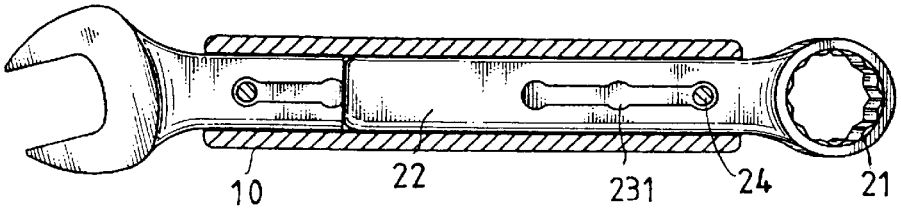
FIG. 17 is a sectional top view of the fourth embodiment of the present invention.
Figure 18:
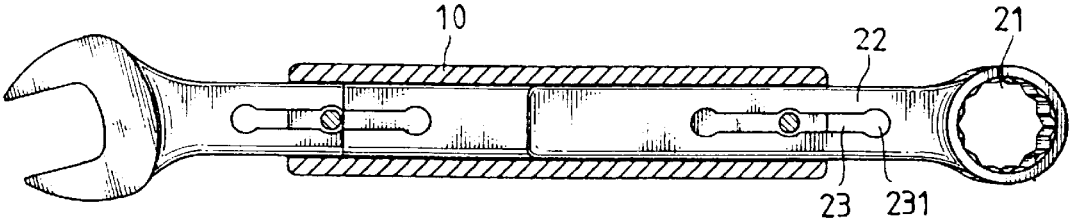
FIG. 18 is another sectional top view of the fourth embodiment of the present invention showing the driving devices extended out of the handle.
Figure 19:
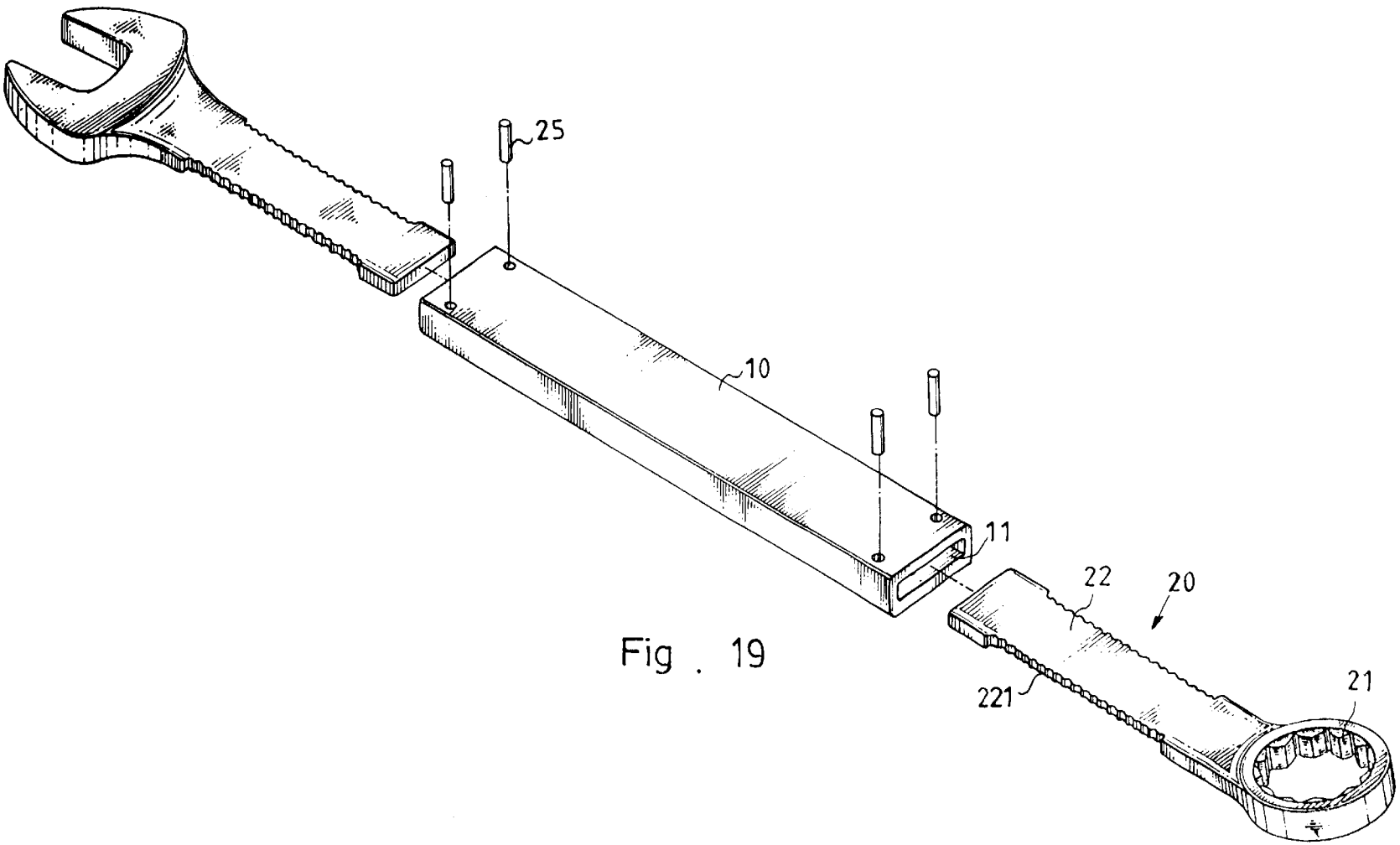
FIG. 19 is an exploded view of a fifth embodiment of the present invention.
Figure 20:
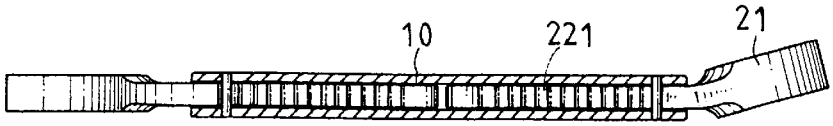
FIG. 20 is a sectional side view of the fifth embodiment of the present invention.
Figure 21:
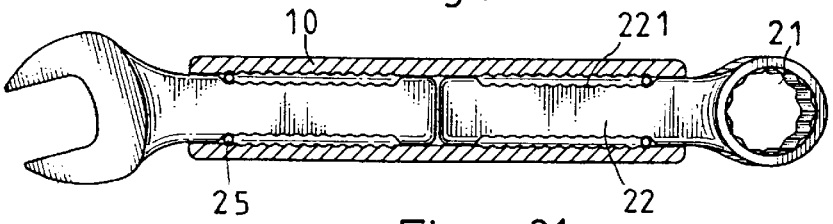
FIG. 21 is a sectional top view of the fifth embodiment of the present invention.
Figure 22:
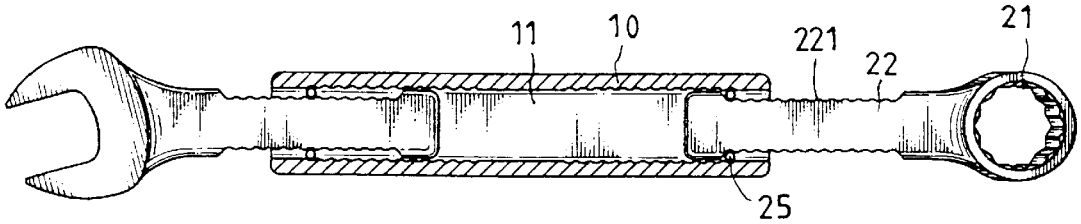
FIG. 22 is another sectional top view of the fifth embodiment of the present invention showing the driving devices extended out of the handle.

Referring to FIGS. from 1 through 4, a wrench is shown comprised of a handle 10, and two driving devices 20. The handle 10 is an elongated hollow member having a receiving hole 11 longitudinally extended through the two distal ends thereof and adapted for receiving the driving devices 20 respectively. Each driving device 20 comprises an elongated shank 22 and a work head 21 at one end of the shank 22. The work head 21 can be a ratchet box end or open end. The shank 22 comprises a longitudinally extended sliding slot 23 and positioning portions 231 disposed in the sliding slot 23 at different locations. The shanks 22 of the driving devices 20 are respectively inserted the receiving hole 11 of the handle 10 from the two distal ends of the handle 10. Two locating members 24 are respectively mounted in the two distal ends of the handle 10 and respectively inserted through the sliding slot 23 of each of the driving devices 20 to secure the driving devices 20 to the handle 10, enabling the driving devices 20 to be axially moved in and out of the receiving hole 11 of the handle 10. The moving range of the driving devices 20 relative to the handle 10 is equal to the length of the sliding slot 23. When pulling one driving device 20 out of the receiving hole 11 of the handle 10 to such an extent that one positioning portion 231 of the sliding slot 23 is forced into engagement with the corresponding locating member 24, the respective driving device 20 is secured in the desired extended position. Further, the locating members 24 may be variously embodied. According to this embodiment, the locating members are short cylindrical rods each having a bottom end terminating in a threaded neck 241 adapted for threading into a screw hole (equivalent to the reference sign 243 shown in FIG. 12) inside the handle 10, and a top end terminating in a hexagonal coupling portion 242 for turning with a hexagonal head wrench tool.

FIGS. from 6 through 9 show a second embodiment of the present invention. According to this embodiment, the sliding slot 23 of each driving device 20 has two opposite sides serrated forming a longitudinal series of positioning portions. When operating the wrench to turn the workpiece (not shown) after the driving devices 20 extended out of the receiving hole of the handle 10, there are bearing points F1, F1'; F2, F2' between the shanks 22 of the driving devices 20 and the inside wall of the handle 10 that support the torsional force.

FIGS. from 10 through 14 show a third embodiment of the present invention. According to this embodiment, the shanks 22 of the driving devices 20 are attached together, and a locating member 24 is fastened to the handle 10 and inserted through the sliding slot 23 of each of the driving devices 20 to secure the driving devices 20 to the handle 10, enabling the driving devices 20 to be respectively moved in and out of the receiving hole 1 of the handle 10.

FIGS. from 15 through 18 show a fourth embodiment of the present invention. According to this embodiment, the shanks 22 of the driving devices 20 are axially slidably secured to the two distal ends of the handle 10 by a respective locating member 24, each having a thinner rear half. The thinner rear halves of the shanks 22 of the driving devices 20 are attached to each other so that the vertical thickness of the handle 10 can be minimized.

FIGS. from 19 through 22 show a fifth embodiment of the present invention. According to this embodiment, the shank 22 of each driving device 20 has two longitudinally extended serrated side edges 221, and locating rods 25 are mounted in each of the two distal ends of the handle 10 at two opposite lateral sides of the receiving hole 11 for engagement with the serrated side edges 221 of the shanks 22 of the driving devices 20 to secure the driving devices 20 in one of a series of positions.

Figure 23:
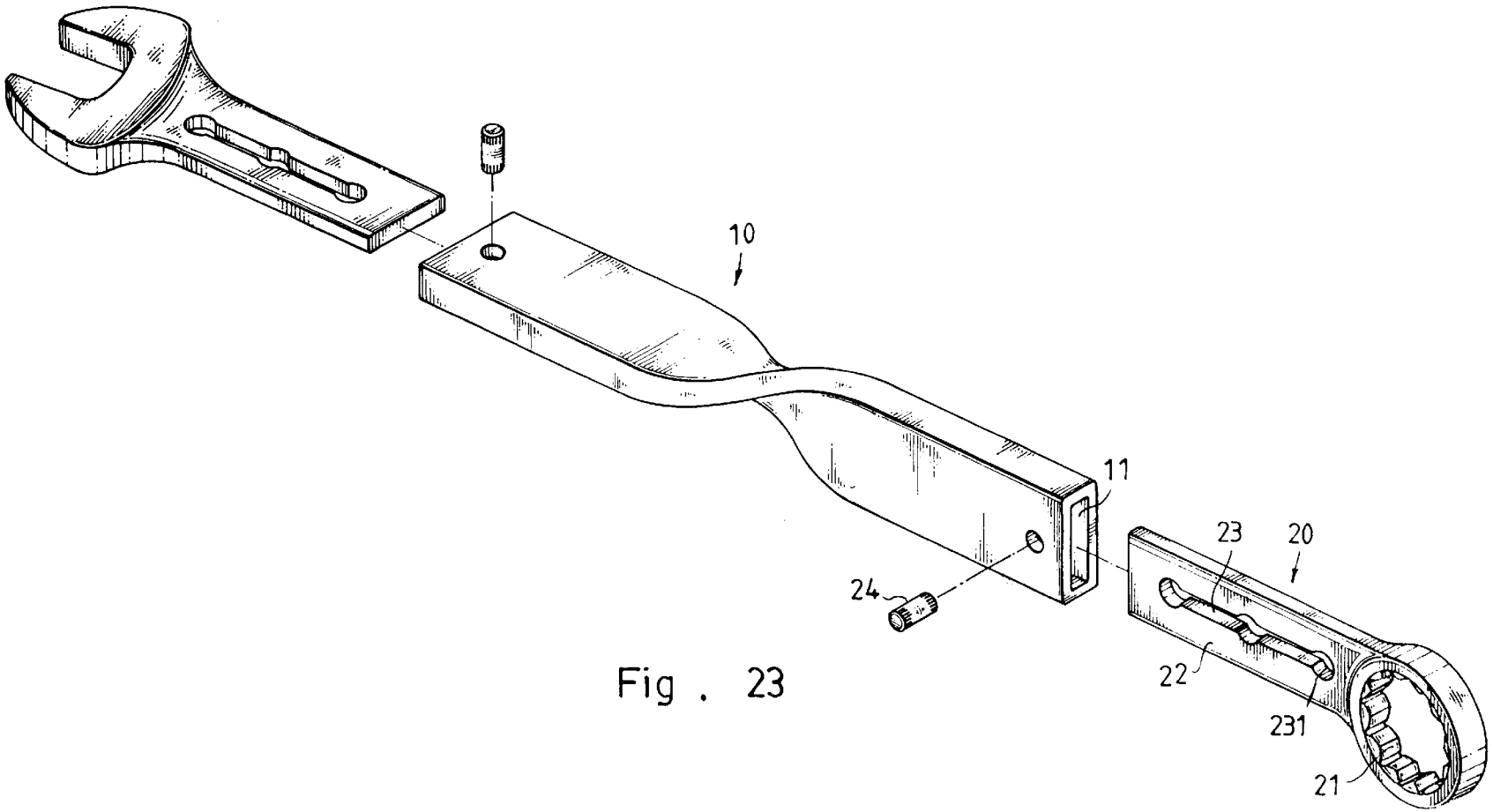
FIG. 23 is an exploded view of a sixth embodiment of the present invention.
Figure 25:
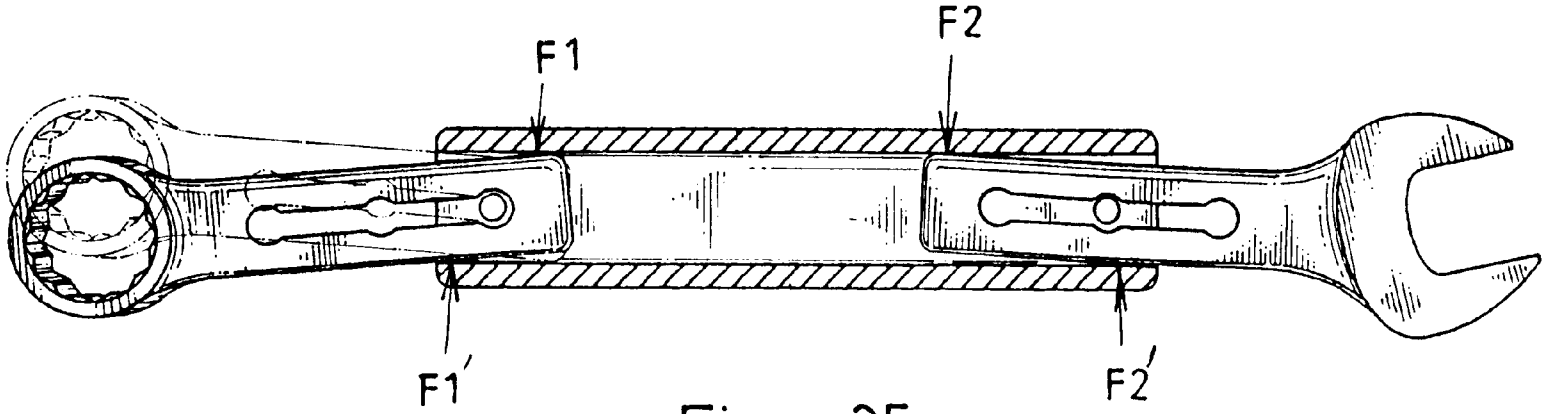
FIG. 25 is a schematic drawing showing the shank of the driving device supported on the inside wall of the handle at two bearing points when operated.
Figure 24:
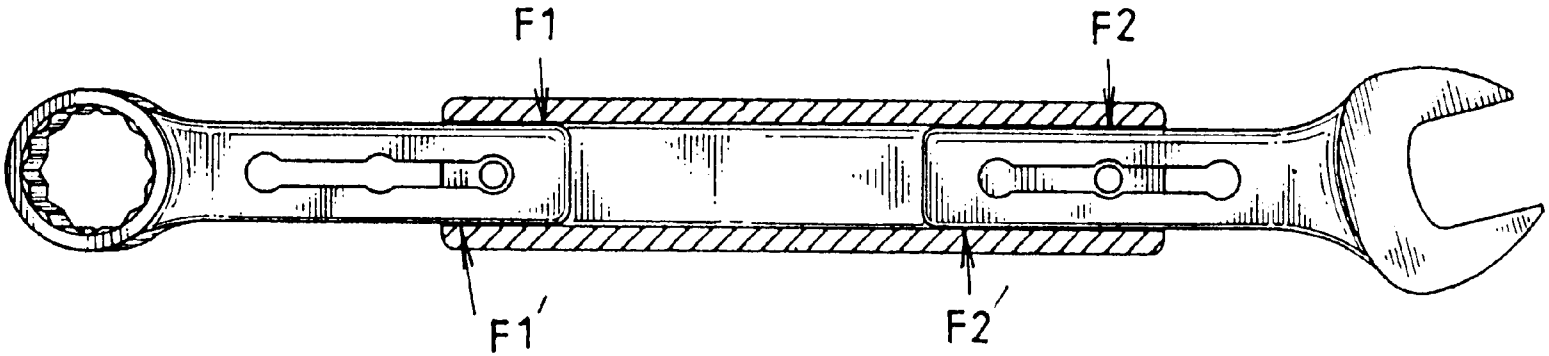
FIG. 24 is a schematic drawing showing locations of the bearing points between the shank of the driving device and the inside wall of the handle.
Figure 26:
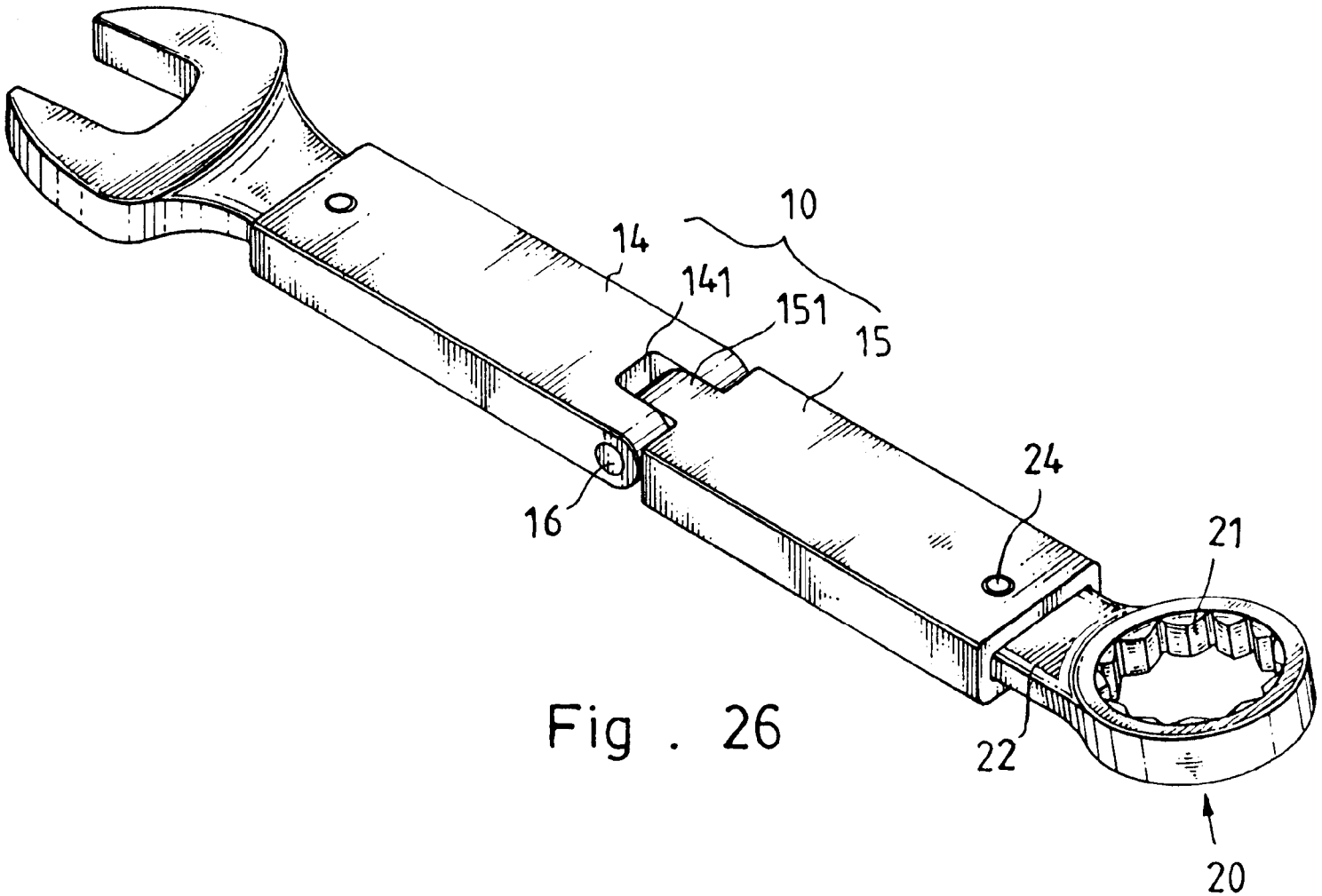
FIG. 26 is an elevational view of a seventh embodiment of the present invention.
Figure 27:
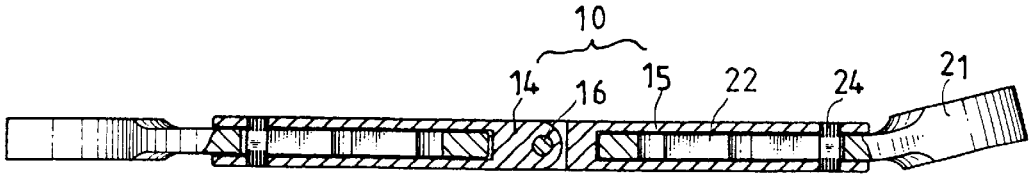
FIG. 27 is a sectional side view of the seventh embodiment of the present invention.
Figure 28:
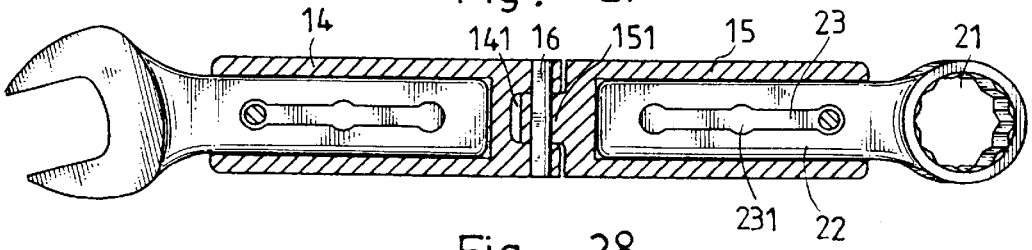
FIG. 28 is a sectional top view of the seventh embodiment of the present invention.
Figure 29:
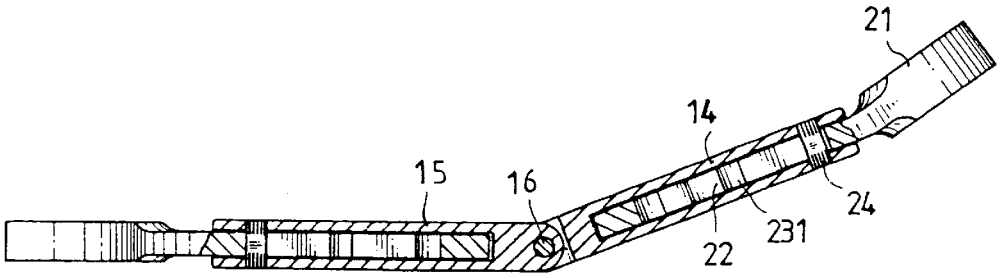
FIG. 29 is another sectional top view of the seventh embodiment of the present invention showing the driving devices extended out of the handle.
Figure 30:
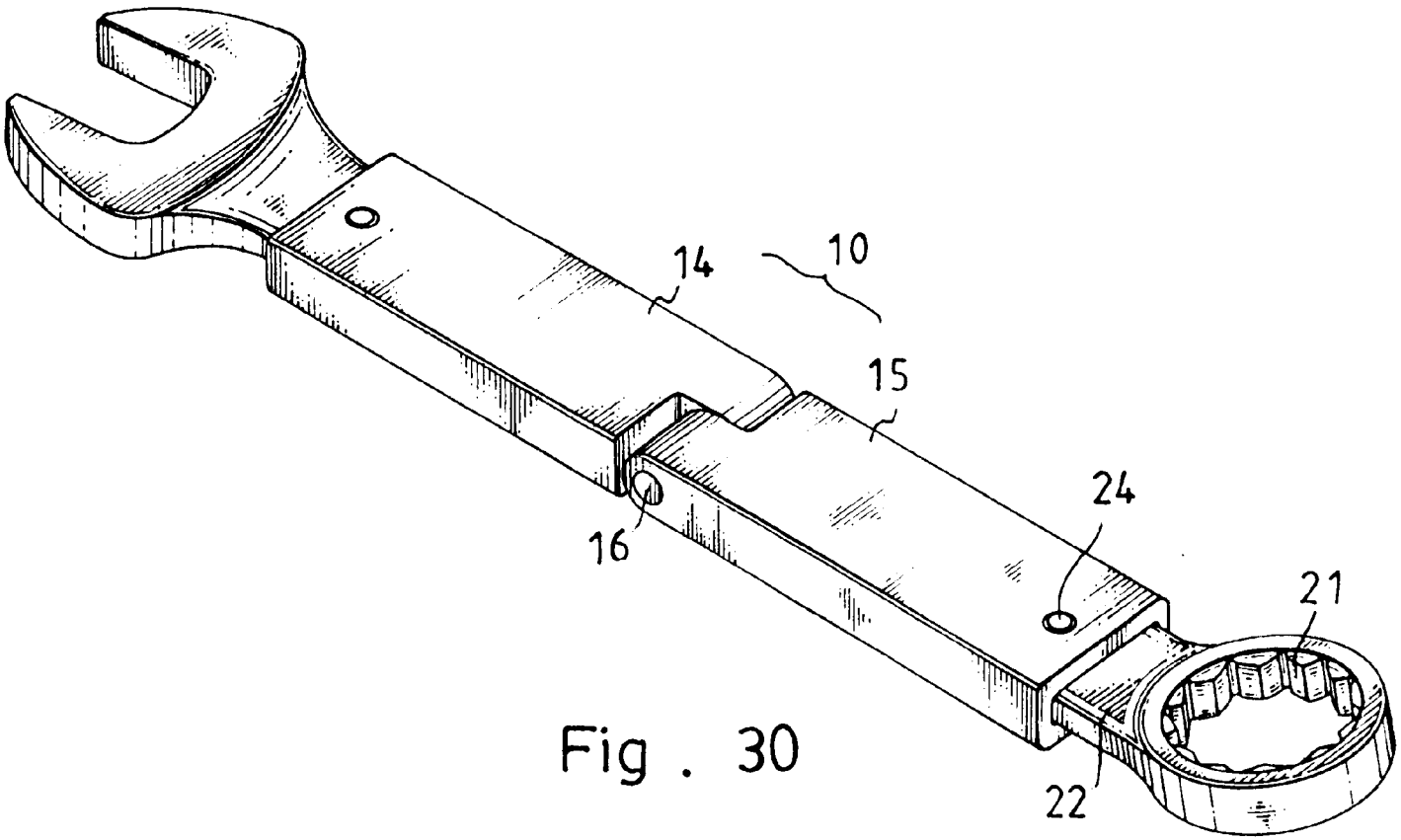
FIG. 30 is an elevational view of an eighth embodiment of the present invention.
Figure 31:
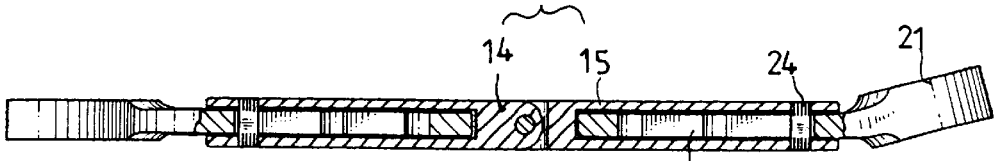
FIG. 31 is a sectional side view of the eighth embodiment of the present invention.
Figure 32:
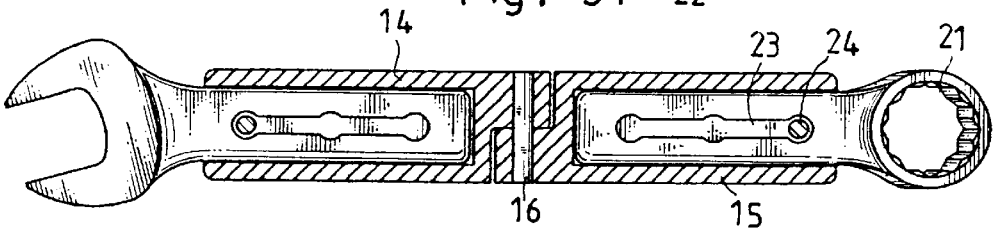
FIG. 32 is a sectional top view of the eighth embodiment of the present invention.
Figure 33:
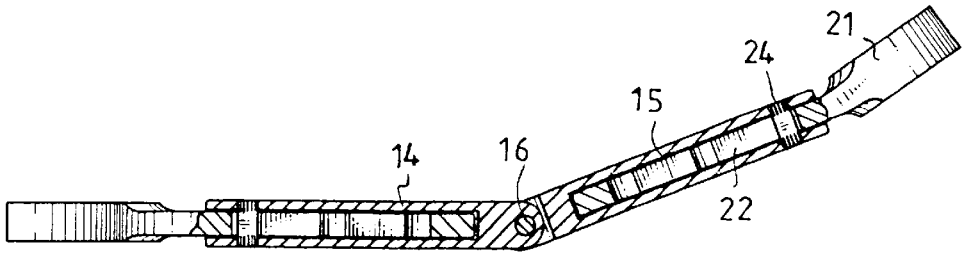
FIG. 33 is another sectional top view of the eighth embodiment of the present invention showing the driving devices extended out of the handle.
Figure 34:
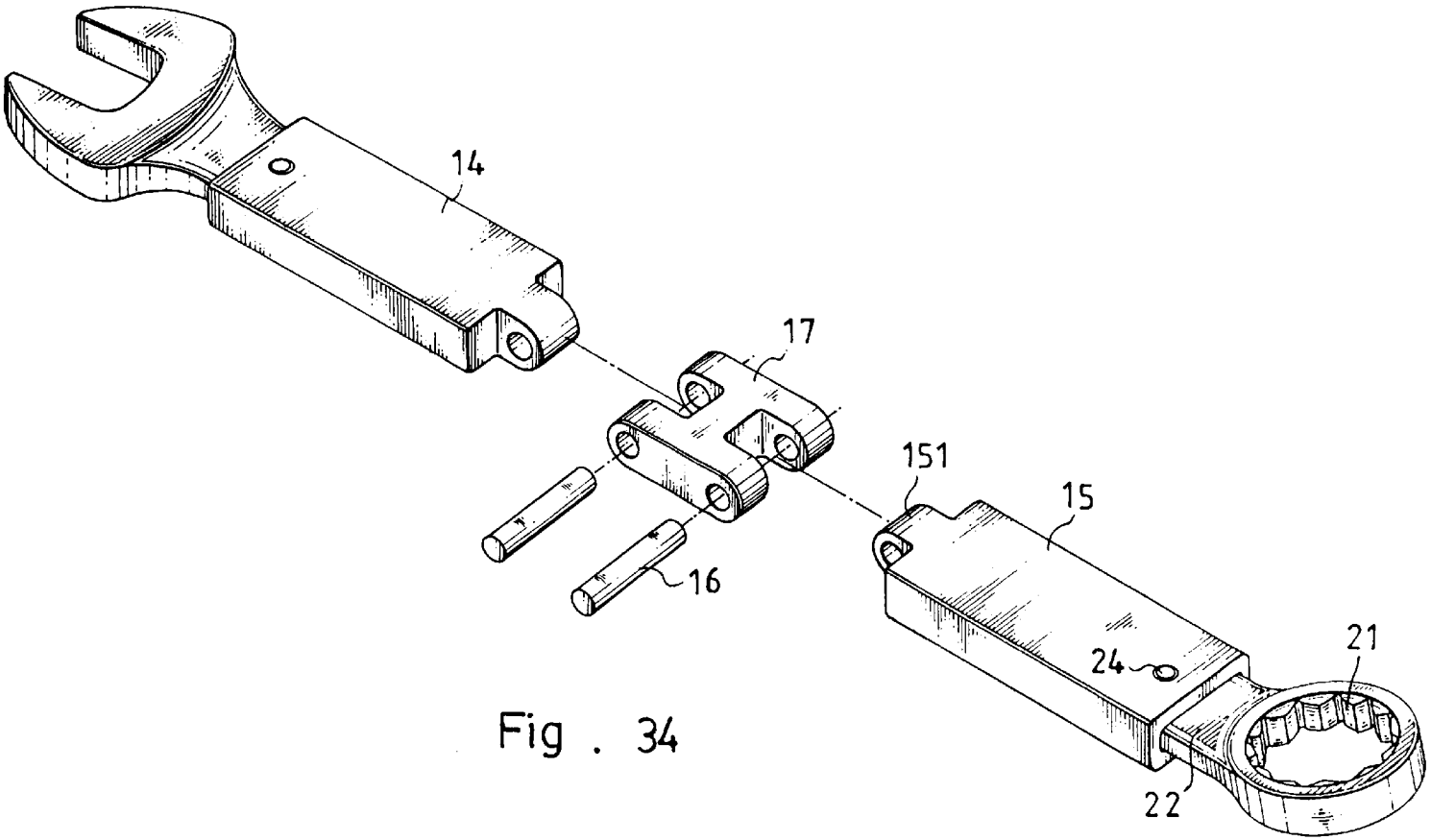
FIG. 34 is an exploded view of a ninth embodiment of the present invention.
Figure 35:
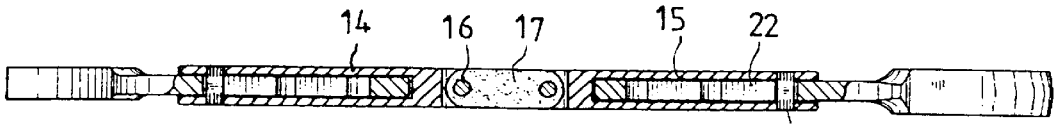
FIG. 35 is a sectional side view of the ninth embodiment of the present invention.
Figure 36:
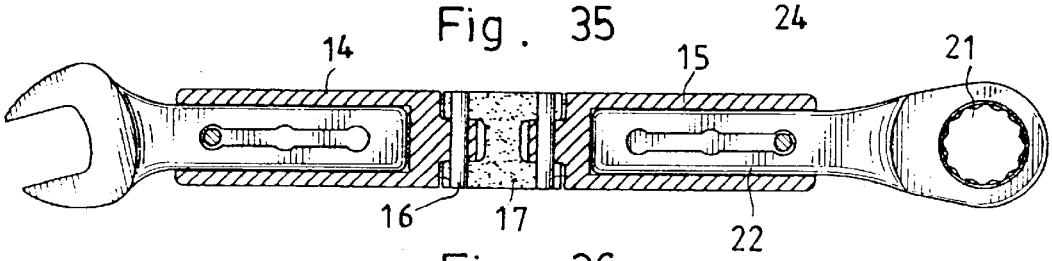
FIG. 36 is a sectional top view of the ninth embodiment of the present invention.
Figure 37:
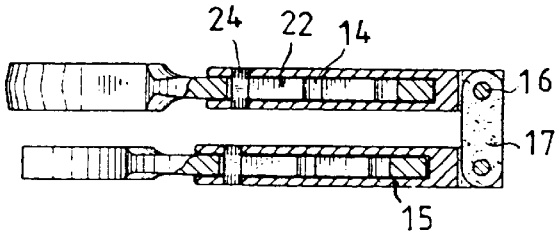
FIG. 37 is a sectional view of the ninth embodiment of the present invention showing the wrench folded up, the driving devices arranged in parallel.
Figure 38:
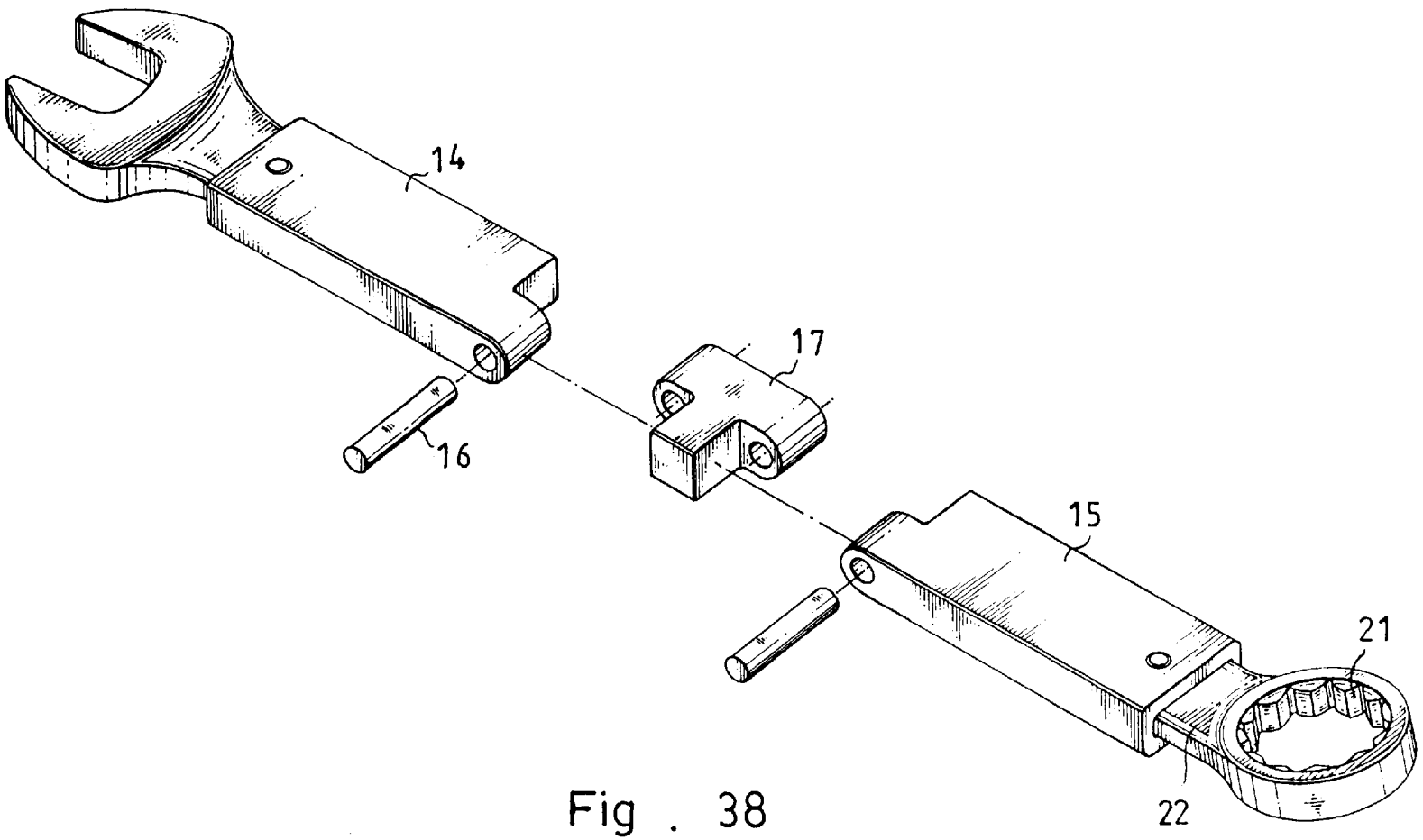
FIG. 38 is an exploded view of a tenth embodiment of the present invention.
Figure 39:
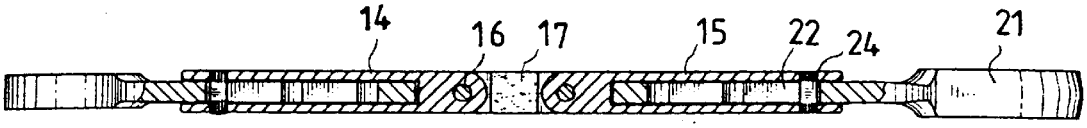
FIG. 39 is a sectional side view of the tenth embodiment of the present invention.
Figure 40:
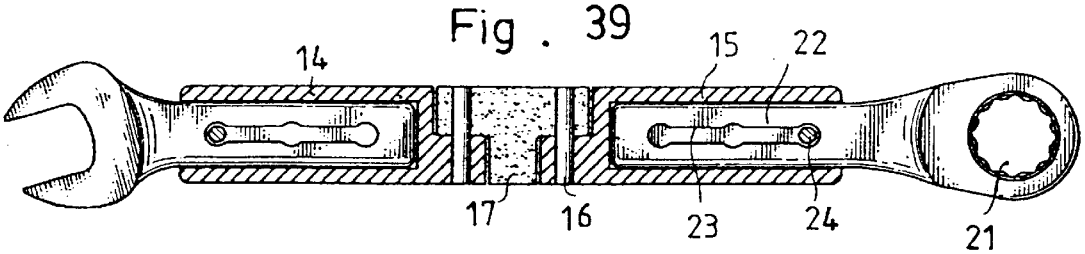
FIG. 40 is a sectional top view of the tenth embodiment of the present invention.
Figure 41:
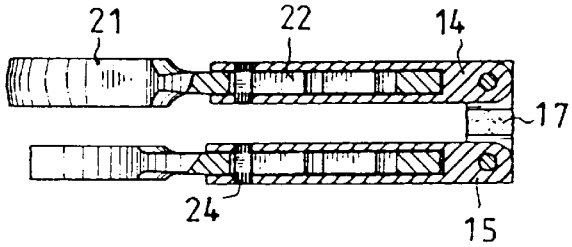
FIG. 41 is a sectional view of the tenth embodiment of the present invention showing the wrench folded up, the driving devices arranged in parallel.

FIG. 23 shows a sixth embodiment of the present invention. According to this embodiment, the handle 10 has a twisted body adapted for holding the driving members 20 at right angles.

FIGS. from 26 through 29 show a seventh embodiment of the present invention. According to this embodiment, the handle 10 is comprised of a first handle element 14, a second handle element 15, and a pivot 16. The first handle element 14 has a forked coupling end 141. The second handle element 15 has a protruded coupling end 151. The pivot 16 is fastened to the forked coupling end 141 of the first handle element 14 and the protruded coupling end 151 of the second handle element 15 to pivotally secure the handle elements 14 and 15 together.

FIGS. from 30 through 33 show an eighth embodiment of the present invention. According to this embodiment, the first handle element 14 and the second handle element 15 have a respective notched rear end attached to each other and pivotally secured together by a pivot 16.

FIGS. from 34 through 37 show a ninth embodiment of the present invention. FIGS. from 38 through 41 show a tenth embodiment of the present invention. According to these two embodiments, a respective pivot 16 respectively pivots the first handle element 14 and the second handle element 15 to a substantially H-shaped coupling block 17.

Figure 42:
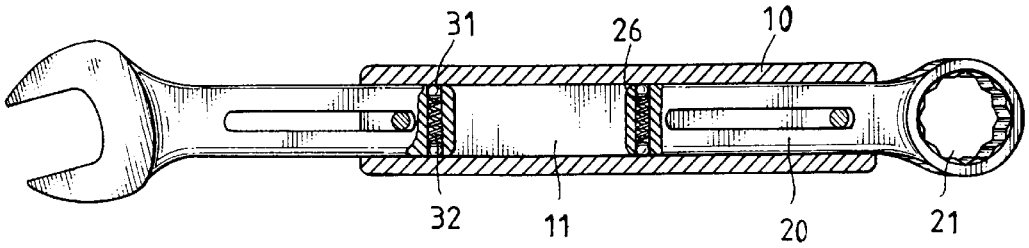
FIG. 42 is a sectional assembly view of an eleventh embodiment of the present invention.
Figure 43:
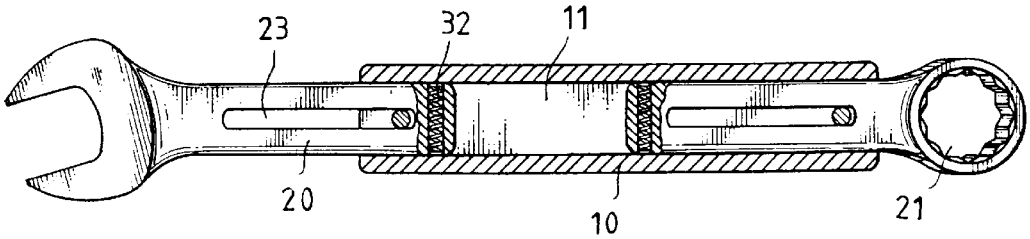
FIG. 43 is a sectional assembly view of a twelfth embodiment of the present invention.
Figure 44:
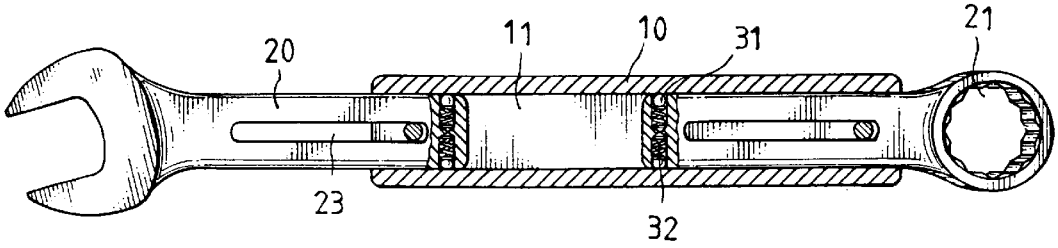
FIG. 44 is a sectional assembly view of a thirteenth embodiment of the present invention.
Figure 45:
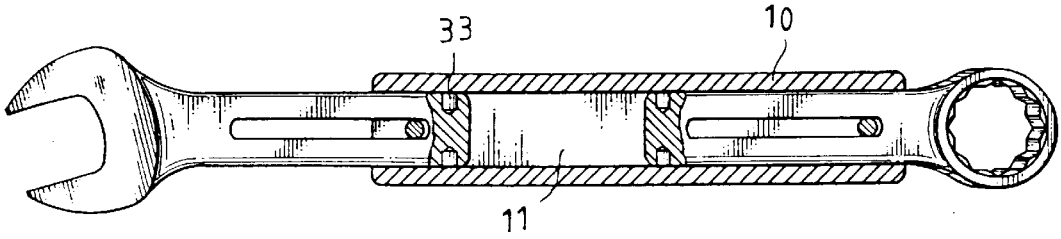
FIG. 45 is a sectional assembly view of a fourteenth embodiment of the present invention.
Figure 46:
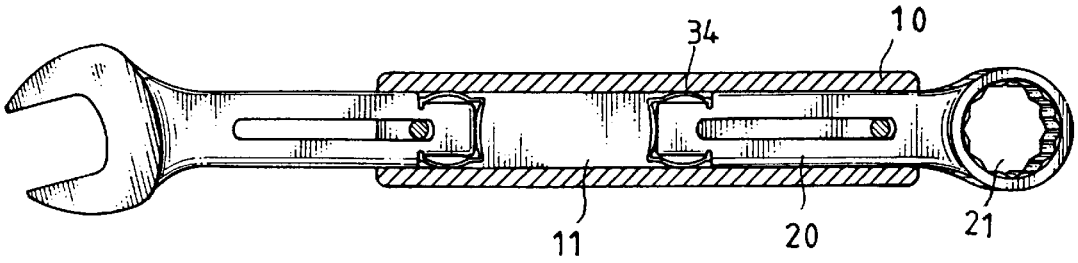
FIG. 46 is a sectional assembly view of a fifteenth embodiment of the present invention.
Figure 47:
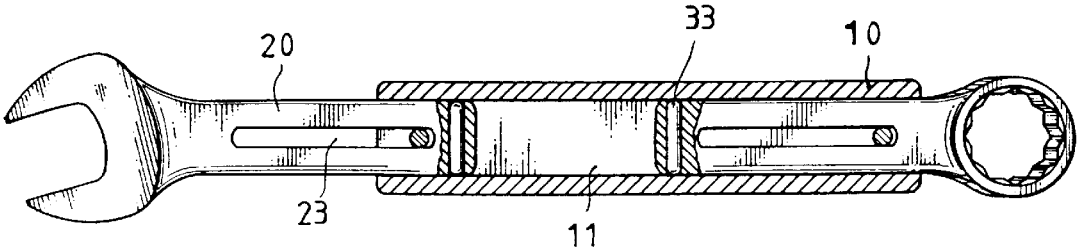
FIG. 47 is a sectional assembly view of a sixteenth embodiment of the present invention.
Figure 48:
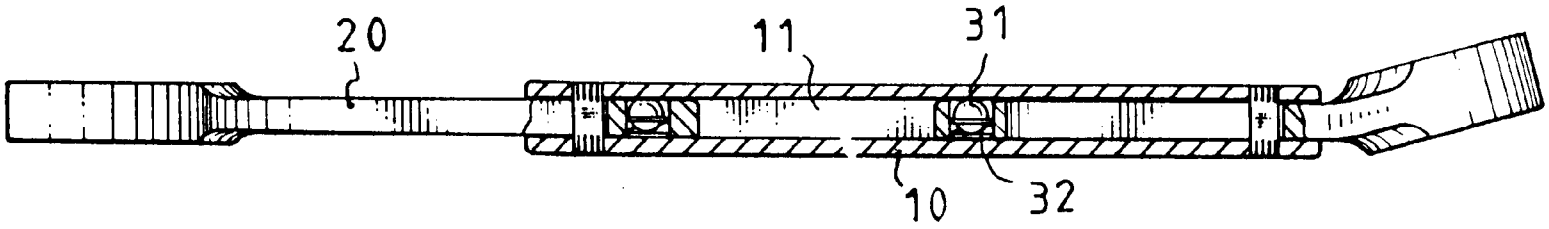
FIG. 48 is a sectional assembly view of a seventeenth embodiment of the present invention.
Figure 49:
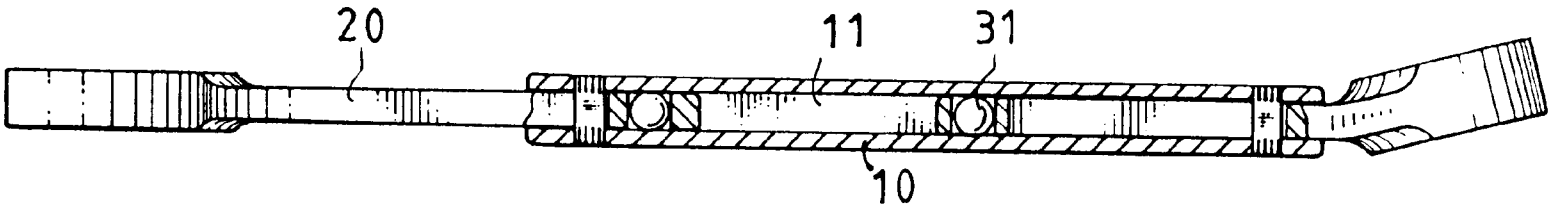
FIG. 49 is a sectional assembly view of an eighteenth embodiment of the present invention.
Figure 50:
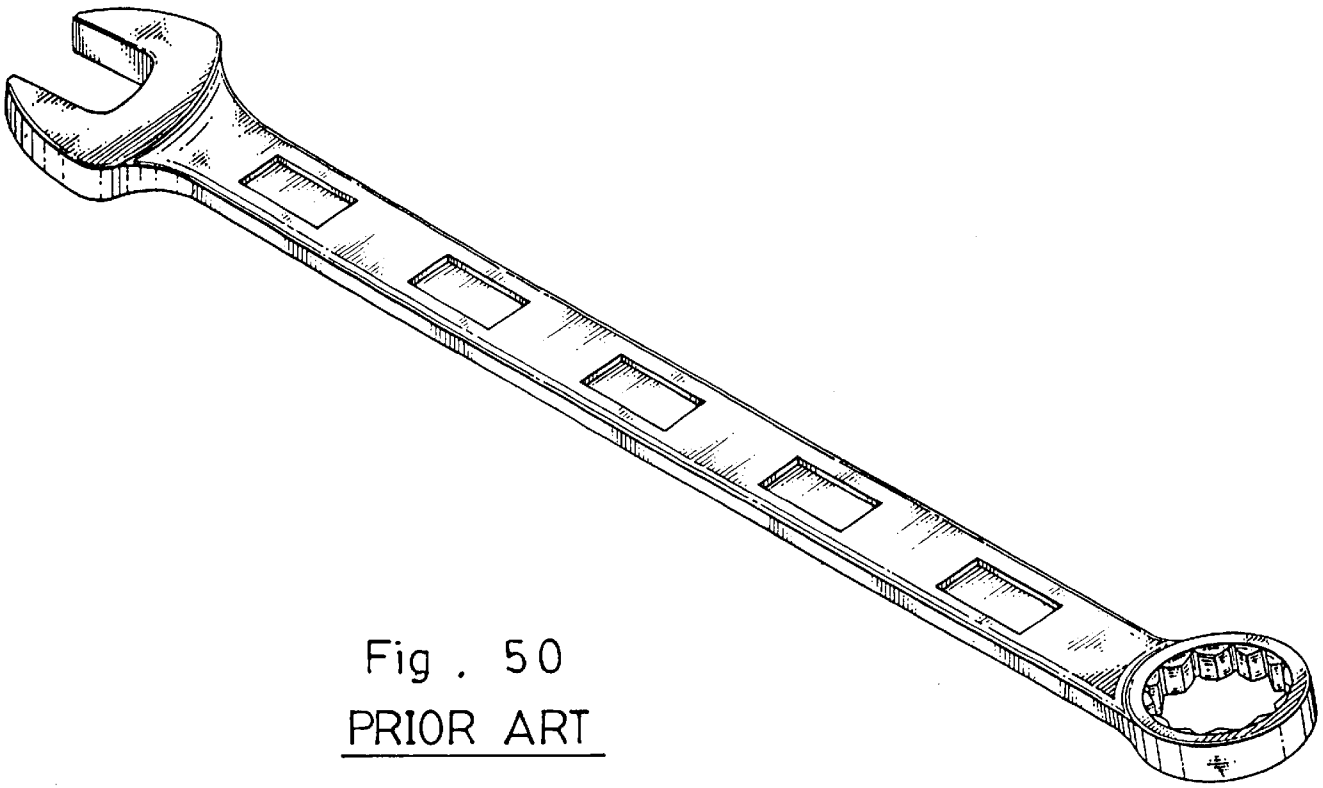
Fig. 50 PRIOR ART
FIG. 50 is an elevational view of a wrench according to the prior art.
Figure 51:
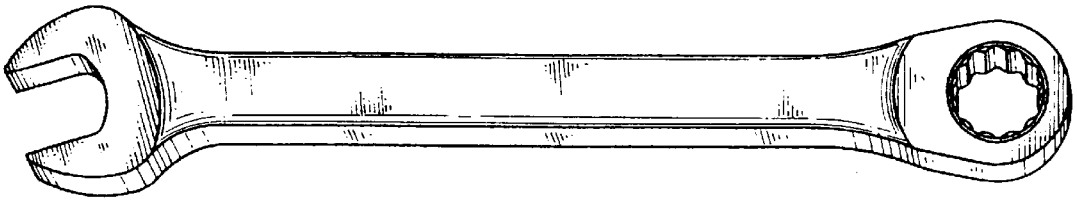
Fig. 51 PRIOR ART
FIG. 51 is an elevational view of another structure of wrench according to the prior art.
Figure 52:
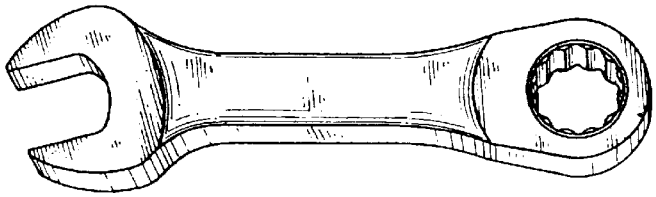
Fig. 52 PRIOR ART
FIG. 52 is an elevational view of still another structure of wrench according to the prior art.

FIGS. from 42 through 49 show other alternate forms of the present invention. In order for positive positioning in the receiving hole 11 of the handle 10, each driving device 20 is provided with a positioning structure. According to the eleventh embodiment shown in FIG. 42, the seventeenth embodiment shown in FIG. 48, and the eighteenth embodiment shown in FIG. 49, a spring member 32 is mounted in a transverse through hole 26 of the shank of each driving device 20, and two steel balls 32 are respectively mounted on the ends of the spring member 32 and stopped against the inside wall of the handle 10. According to the twelfth embodiment shown in FIG. 43, a spring member 32 is mounted in a transverse through hole in the shank of each driving device 20, having two distal ends respectively stopped against the inside wall of the handle 10. According to the thirteenth embodiment shown in FIG. 44, spring members 31 and steel balls 32 are installed in the driving devices 20 for quick positioning in the handle 10. According to the fourteenth embodiment shown in FIG. 45 and the sixteenth embodiment shown in FIG. 47, friction rods 33 are respectively installed in the shanks of the driving devices 20 for quick positioning in the handle 10. According to the fifteenth embodiment shown in FIG. 46, arched spring leaves 34 are respectively installed in the shanks of the driving devices 20 for quick positioning in the handle 10.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A wrench comprising:

a handle, said handle having a receiving hole extended through two distal ends thereof;

two driving devices respectively coupled to the two distal ends of said handle and moved in and out of the receiving hole of said handle, said driving devices each comprising a shank inserted into the receiving hole of said handle and a work head integral with one end of said shank outside said handle, said shank having a longitudinal sliding slot; and locating means mounted in said handle and inserted through the sliding slot of the shank of each of said driving devices to secure said driving devices to said handle for enabling said driving devices to be moved in and out of the receiving hole of said handles, wherein the sliding slot of the shank of each of said driving devices having a plurality of positioning portions for engagement with said locating means to secure the respective driving device in one of a series of positions.

2. A wrench comprising:

a handle, said handle having a receiving hole extended through two distal ends thereof:

two driving devices respectively coupled to the two distal ends of said handle and moved in and out of the receiving hole of said handle, said driving devices each comprising a shank inserted into the receiving hole of said handle and a work head integral with one end of said shank outside said handle, said shank having a longitudinal sliding slot; and locating means mounted in said handle and inserted through the sliding slot of the shank of each of said driving devices to secure said driving devices to said handle for enabling said driving devices to be moved in and out of the receiving hole of said handle, wherein said locating means comprises two locating rods respectively pivoted to the two distal ends of said handle and respectively inserted through the sliding slots of the shanks of said driving devices.

3. The wrench as claimed in claim 2 wherein said locating rods each have a bottom end terminating in a threaded neck adapted for threading into a screw hole inside said handle, and a top end terminating in a hexagonal coupling portion for turning with a hexagonal head wrench tool.

4. A wrench comprising:

a handle, said handle having a receiving hole extended through two distal ends thereof;

two driving devices respectively coupled to the two distal ends of said handle and attached to each other at different elevations and moved relative to each other in and out of the receiving hole of said handle, said driving devices each comprising a shank inserted into the receiving hole of said handle and a work head integral with one end of said shank outside said handle, said shank having a longitudinal sliding slot; and locating means mounted in said handle and inserted through the sliding slot of the shank of each of said driving devices to secure said driving devices to said handle for enabling said driving devices to be moved in and out of the receiving hole of said handle, wherein the sliding slot of the shank of each of said driving devices having a plurality of positioning portions for engagement with said locating means to secure the respective driving device in one of a series of positions.

5. A wrench comprising:

a handle, said handle having a receiving hole extended through two distal ends thereof;

two driving devices respectively coupled to the two distal ends of said handle and moved in and out of the receiving hole of said handle, said driving devices each comprising a shank inserted into the receiving hole of said handle and a work head integral with one end of said shank outside said handle, said shank having a longitudinal sliding slot; and locating means mounted in said handle and inserted through the sliding slot of the shank of each of said driving devices to secure said driving devices to said handle for enabling said driving devices to be moved in and out of the receiving hole of said handle, wherein said shanks of said driving devices each have a thick front half and a thin rear half, the thin rear halves of said shanks of said driving devices being relatively slidably attached to each other.

6. A wrench comprising:

a twisted handle body, said twisted handle body having two receiving holes in two ends thereof adapted for holding two driving devices at right angles;

two driving devices respectively coupled to the two distal ends of said handle and moved in and out of the receiving holes of said handle, said driving devices each comprising a shank inserted into the receiving hole of said handle and a work head integral with one end of said shank outside said handle, said shank having a longitudinal sliding slot; and locating means mounted in the two distal ends of said handle and inserted through the sliding slots of the shanks of said driving devices to secure said driving devices to said handle for enabling said driving devices to be moved in and out of the receiving holes of said handle.

7. A wrench comprising:

a handle, said handle comprising a first handle element, said first handle element having a receiving hole longitudinally disposed in one end thereof and a coupling portion disposed in an opposite end thereof, a second handle element, said second handle element having a receiving hole longitudinally disposed in one end thereof and a coupling portion disposed in an opposite end thereof, and pivot means adapted for securing the coupling portion of said second handle element to the coupling portion of said first handle element;

two driving devices respectively coupled to said first handle element and said second handle element of said handle and respectively moved in and out of the receiving holes of said first handle element and said second handle element, said driving devices each comprising a shank inserted into the receiving hole of one handle element of said handle and a work head integral with one end of said shank outside said handle, said shank having a longitudinal sliding slot; and locating means respectively mounted in the handle elements of said handle and inserted through the sliding slots of the shanks of said driving devices to secure said driving devices to the handle elements of said handle for enabling said driving devices to be respectively moved in and out of the receiving holes of the handle elements of said handle, wherein the sliding slot of the shank of each of said driving devices having a plurality of positioning portions for engagement with said locating means to secure the respective driving device in one of a series of positions.

8. A wrench comprising:

a handle, said handle comprising a first handle element, said first handle element having a receiving hole longitudinally disposed in one end thereof and a coupling portion disposed in an opposite end thereof, a second handle element, said second handle element having a receiving hole lougitudinally disposed one end thereof and a coupling portion disposed in an opposite end thereof, and pivot means adapted for securing the coupling portion of said second handle element to the coupling portion of said first handle element;

two driving devices respectively coupled to said first handle element and said second handle element of said handle and respectively moved in and out of the receiving holes of said first handle element and said second handle element, said driving devices each comprising a shank inserted into the receiving hole of one handle element of said handle and a work head integral with one end of said shank outside said handle, said shank having a longitudinal sliding slot; and locating means respectively mounted in the handle elements of said handle and inserted through the sliding slots of the shanks of said driving devices to secure said driving devices to the handle elements of said handle for enabling said driving devices to be respectively moved in and out of the receiving holes of the handle elements of said handle, wherein said handle further comprises a H-shaped coupling block coupled between the coupling portions of said first handle element and said second handle element, and said pivot means comprises two pivots respectively fastened to the coupling portions of said first handle element and said second handle element and pivoted to said H-shaped coupling block.

9. A wrench comprising:

a handle, said handle having a receiving hole extended through two distal ends thereof;

two driving devices respectively coupled to the two distal ends of said handle and moved in and out of the receiving hole of said handle, said driving devices each comprising a shank inserted into the receiving hole of said handle and a work head integral with one end of said shank outside said handle, said shank having a longitudinal sliding slot; and locating means mounted in said handle and inserted through the sliding slot of the shank of each of said driving devices to secure said driving devices to said handle for enabling said driving devices to be moved in and out of the receiving hole of said handle, wherein the shank of each of said driving devices comprises a transversely extended through hole, a spring member mounted in said transversely extended through hole, and two steel balls respectively mounted on two distal ends of said spring member and stopped against an inside wall of said handle.

* * * * *